US006179693B1

(12) United States Patent
Beardsley et al.

(10) Patent No.: US 6,179,693 B1
(45) Date of Patent: Jan. 30, 2001

(54) IN-SITU/SELF-PROPELLED POLISHING PAD CONDITIONER AND CLEANER

(75) Inventors: Gary Joseph Beardsley, Underhill; Cuc Kim Huynh, Jericho; David Louis Walker, Enosburg Falls, all of VT (US)

(73) Assignee: International Business Machines Corporation, Armonk, NY (US)

( * ) Notice: Under 35 U.S.C. 154(b), the term of this patent shall be extended for 0 days.

(21) Appl. No.: 09/166,785

(22) Filed: Oct. 6, 1998

(51) Int. Cl.[7] ..... B24B 1/00; B24B 55/00
(52) U.S. Cl. ..... 451/56; 451/443
(58) Field of Search ..... 451/443, 444, 451/56, 41, 287, 288, 285

(56) References Cited

U.S. PATENT DOCUMENTS

| | | | | |
|---|---|---|---|---|
| 5,154,021 | | 10/1992 | Bombardier | 451/444 |
| 5,245,796 | * | 9/1993 | Miller et al. | 51/283 R |
| 5,384,986 | * | 1/1995 | Hirose et al. | 451/444 |
| 5,456,627 | * | 10/1995 | Jackson et al. | 451/11 |
| 5,486,131 | * | 1/1996 | Cesna et al. | 451/56 |
| 5,547,417 | * | 8/1996 | Breivogel et al. | 451/58 |
| 5,611,943 | * | 3/1997 | Cadien et al. | 216/88 |
| 5,629,509 | * | 5/1997 | Hayashi | 451/285 |
| 5,645,682 | * | 7/1997 | Skrovan | 156/636.1 |
| 5,709,593 | * | 1/1998 | Guthrie et al. | 451/287 |
| 5,785,585 | | 7/1998 | Manfredi et al. | 451/288 |
| 5,830,043 | * | 11/1998 | Aaron et al. | 451/72 |
| 5,885,137 | * | 3/1999 | Ploessl | 451/56 |
| 5,948,203 | * | 9/1999 | Wang | 156/345 |
| 5,957,754 | * | 9/1999 | Brown et al. | 451/41 |

* cited by examiner

*Primary Examiner*—Joseph J. Hail, III
(74) *Attorney, Agent, or Firm*—DeLio & Peterson LLC; Peter W. Peterson; Howard J. Walter, Jr.

(57) ABSTRACT

A non-motorized polishing pad conditioner and cleaner having a free-wheeling conditioner head with a plurality of channels to direct the flow of a cleansing fluid; a hollow shaft connected to a fluid source; and a conditioning pad to facilitate loosening the debris found on a polishing pad wherein the pad conditioner and cleaner is self-propelled upon contact with a rotating polishing pad. A cantilever may be used to attach the conditioner and cleaner adjacent to the polishing apparatus. The cantilever may contain a motorized element for extending and retracting the conditioner and cleaner over the radius of a polishing pad such that the entire surface of the polishing pad may be conditioned and cleaned. A method of conditioning and cleaning a polishing pad while simultaneously polishing a silicon wafer is also described.

21 Claims, 5 Drawing Sheets

IN-SITU/SELF-PROPELLED POLISHING PAD CONDITIONER AND CLEANER

BACKGROUND OF THE INVENTION

1. Field of the Invention

This invention relates to polishing apparatus, in particular to a conditioning and cleaning apparatus for use during chemical mechanical polishing of a semiconductor wafer.

2. Description of Related Art

Fabrication of semiconductor integrated circuits (IC) is a complicated multi-step process for creating microscopic structures with various electrical properties to form a connected set of devices. As the level of integration of IC's increases, the devices become smaller and more densely packed, requiring more levels of photolithography and more processing steps. As more layers are built up on the silicon wafer, problems caused by surface non-planarity become increasingly severe and can impact yield and chip performance. During the fabrication process, it may become necessary to remove excess material in a process referred to as planarization.

A common technique used to planarize the surface of a silicon wafer is chemical mechanical polishing (CMP). CMP involves the use of a polishing pad affixed to a circular polishing table and a holder to hold the wafer face down against the rotating pad. A slurry containing abrasive and chemical additives are dispensed onto the polishing pad. The pad itself is typically chosen for its ability to act as a carrier of the slurry and to wipe away the grit and debris resulting from the polishing action.

The wafer and polishing pad rotate relative to each other. The rotating action along with the abrasive and chemical additives of the slurry results in a polishing action that removes material from the surface of the wafer. Protrusions on the surface erode more efficiently than recessed areas leading to a flattening or planarization of the wafer surface.

A key factor in maintaining the performance and longevity of the CMP apparatus is conditioning the polishing pad. Typically, the polishing pad is comprised of blown polyurethane with a felt surface layer containing many small pores to facilitate the flow of slurry to beneath the wafer being polished. There are tiny fingers of polyurethane which are substantially perpendicular to the surface of the polishing pad. An example of such a polishing pad is the model IC-1000 manufactured by the Rodel Corporation, 945 East San Salvador Drive, Scottsdale, Ariz. 85258.

As the number of wafers polished increases, the polishing pad becomes filled with debris formed by the accumulation of chemical reaction products and abrasives from the slurry. This causes the polishing pad to become matted down or to wear unevenly, also known as the "glazing effect". Thus, it becomes necessary to restore the polishing pad to a state suitable for continued wafer polishing.

The prior art is replete with methods and apparatus used to condition polishing pads. However, almost all the techniques suffer from being cumbersome or complex. The complicated nature of IC manufacturing requires specialized, high cost equipment in terms of price and subsequent operation and maintenance. Therefore, it is a great advantage to having a simple, low cost, low maintenance polishing pad conditioning technique.

Bearing in mind the problems and deficiencies of the prior art, it is therefore an object of the present invention to provide a simple, low cost, low maintenance polishing pad conditioner.

It is another object of the present invention to provide an apparatus for in-situ conditioning and cleaning of a polishing pad.

A further object of the invention is to provide a non-motorized, self-propelling polishing pad conditioner and cleaner.

It is yet another object of the present invention to provide a method of conditioning and cleaning a polishing pad while simultaneously polishing a silicon wafer.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, an apparatus for in-situ conditioning and cleaning polishing pads comprising a free-wheeling conditioner head having a top portion and a bottom portion, the bottom portion having a plurality of channels; and a hollow shaft extending from the top portion of the conditioner head connected to a fluid source, wherein fluid is adapted to be delivered into the conditioner head through the hollow shaft to flow along the channels of the conditioner head. The plurality of channels are open to the bottom portion of said conditioner head and radially extend from the center of the conditioner head towards the edge of the conditioner head.

The apparatus for in-situ conditioning and cleaning polishing pads further includes a conditioning pad attachable to the bottom portion of the conditioner head having a plurality of apertures corresponding to the channels of the conditioner head wherein the conditioner head is adapted to deliver fluid from the hollow shaft into the conditioner head along the channels, and out through the apertures of the conditioning pad.

Preferably, the conditioner head has a top portion with means for adjusting the contact force of the conditioner head onto a polishing pad.

Preferably, the conditioner head is circular having a diameter from about the diameter of a wafer holder to about the radius of a polishing pad.

The conditioner head in the first aspect of the present invention is free-wheeling such that contact with a rotating polishing pad causes free rotation of the conditioner head at about the same speed as the rotating polishing pad wherein conditioning and cleaning of the polishing pad occurs during rotation of the polishing pad.

The apparatus for in-situ conditioning and cleaning polishing pads may further include a cantilever attached to the conditioner head. In addition, the apparatus for in-situ conditioning and cleaning may further include an extension and retraction means attached to one end of the cantilever for extending and retracting the conditioner head such that the conditioner head moves radially on a polishing pad allowing conditioning and cleaning of the entire polishing pad.

In another aspect, the present invention relates to a free-wheeling conditioning and cleaning head comprising a freely rotating conditioner head having a bottom portion and a top portion, the bottom portion having a plurality of channels; a roughened disc attachable to the bottom surface of the conditioner head having a plurality of apertures corresponding to the channels of the conditioner head; and a hollow shaft extending into the conditioner head for delivery of a cleansing fluid along the channels of the conditioner head. The free-wheeling rotating conditioner head may further include a means for attaching weights to the conditioning head to adjust the contact force of the conditioning head on a polishing pad.

In a further aspect, the present invention relates to a self-conditioning and self-cleaning polishing apparatus comprising a rotating polishing pad having a surface; a holder for holding an object to be polished against the polishing pad; a free-wheeling conditioner head having a plurality of trenches disposed on the surface of the polishing pad; and a hollow shaft connected to a cleansing fluid source, the hollow shaft extending into the conditioner head to deliver the cleansing fluid into the conditioner head such that fluid flow is directed by the trenches, wherein the rotational energy of the rotating polishing pad propels the conditioner head to freely rotate when contacted with the rotating polishing pad allowing the conditioner head to loosen any debris on the polishing pad and the injection of the cleansing fluid flushes away the loosened debris on the polishing pad.

The self-conditioning and self-cleaning polishing apparatus may further include an agitator secured to a bottom portion of the conditioner head. The agitator comprises a roughened surface having a shape conforming to the shape of the conditioner head, and a plurality of apertures corresponding to the trenches of the conditioner head such that the cleaning fluid is sprayed through the apertures. Also, the self-conditioning and self-cleaning polishing apparatus may further include a means for attaching weights to the conditioner head to adjust the contact force of the conditioner head onto the polishing pad.

In still yet another aspect, the present invention relates to a method of conditioning and cleaning a polishing pad while simultaneously polishing a silicon wafer comprising the steps of: (a) providing a rotating polishing pad; (b) providing a silicon wafer in need of polishing; (c) providing a silicon wafer holder to contact the wafer with the polishing pad; (d) providing a free-wheeling conditioning and cleaning apparatus having a conditioning surface adapted to deliver a cleansing fluid through the conditioning surface; (e) rotating the polishing pad; (f) contacting a first portion of the polishing pad with the wafer to polish the wafer; and (g) contacting a second portion of the polishing pad with the free-wheeling conditioning and cleaning apparatus such that rotation of the polishing pad causes the free-wheeling conditioning and cleaning apparatus to freely rotate on the polishing pad to condition and clean the polishing pad.

The free-wheeling conditioning and cleaning apparatus is connected to a fluid source such that the fluid flows into the free-wheeling conditioning and cleaning apparatus and is ejected out through the conditioning surface onto the polishing pad to wash away any polishing debris found on the polishing pad. Preferably, the conditioning surface has a plurality of apertures through which the cleansing fluid is ejected onto the polishing pad.

The method of conditioning and cleaning a polishing pad while simultaneously polishing a silicon wafer may further include the step of discontinuing contacting the wafer to the polishing pad and cleaning the polishing pad by ejecting a cleansing fluid onto the polishing pad.

The conditioning and cleaning apparatus in the present method may further include a means for adjusting the contact force of the conditioning and cleaning apparatus onto the polishing pad.

The conditioning and cleaning apparatus in the present method may be adapted to radially move over the surface of the polishing pad such that the entirety of the polishing pad is conditioned.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENTS

Figure 1:
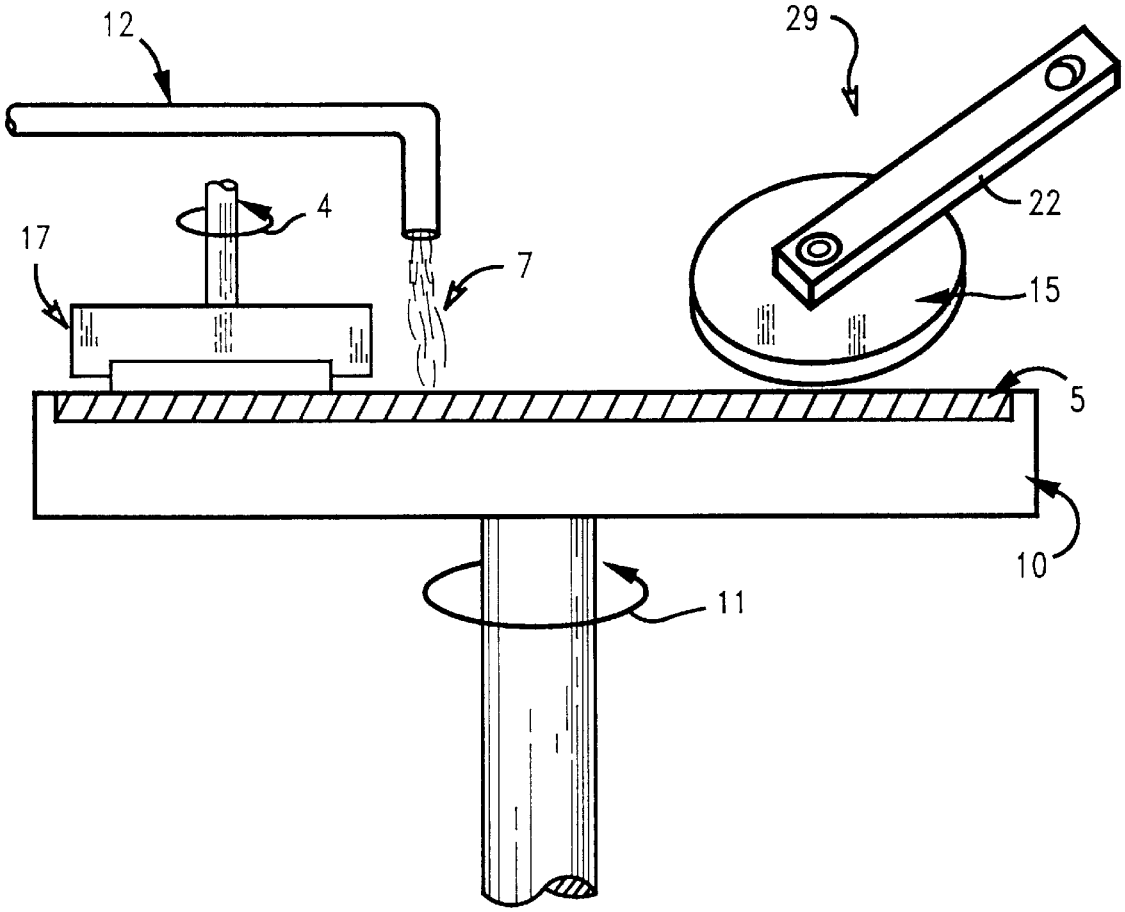
FIG. 1 is an elevational schematic view of the conditioning and cleaning apparatus of the present invention in conjunction with a CMP polisher.

In describing the preferred embodiment of the present invention, reference will be made herein to FIGS. 1–5B of the drawings in which like numerals refer to like features of the invention. Features of the invention are not necessarily shown to scale in the drawings.

Prior art CMP apparatus which can be used with the present invention is shown in FIG. 1. A rotating platen 10 supports a polishing pad 5 which covers almost the entire top surface of the platen 10. The platen 10 is rotated in the direction of arrow 11 driven by a motor (not shown). A first portion of polishing pad 5 is contacted with wafer holder 17 containing a silicon wafer in need of polishing. The wafer holder is motorized and rotates in the direction of arrow 4 relative to the rotating platen 10. A slurry 7 of chemicals and abrasives are directed onto the polishing pad 5 from a slurry source 12. One example of a slurry usable for polishing deposited layers of a silicon wafer is a colloidal suspension of silica particles in a potassium hydroxide solution having a pH of about 8.3 to about 8.7.

A preferred embodiment of the present invention is referred to with numeral 29. The condition and cleaning apparatus 29 may be mounted on or adjacent to the CMP apparatus by the cantilever 22. The free-wheeling, rotatable conditioner head 15 is in contact with a second portion of polishing pad 5. As the conditioner head 15 contacts the second portion of the rotating polishing pad 5, the internal rotational energy of the platen 10 propels the free-wheeling conditioner head 15 causing it to rotate at or about the same speed as the rotating platen. Rotation of conditioner head 15 is achieved without the use of a motor. Placement of conditioner head 15 onto polishing pad 5 can be performed by a technician during the beginning of the polishing queue and left there until the queue is complete.

Figure 2:
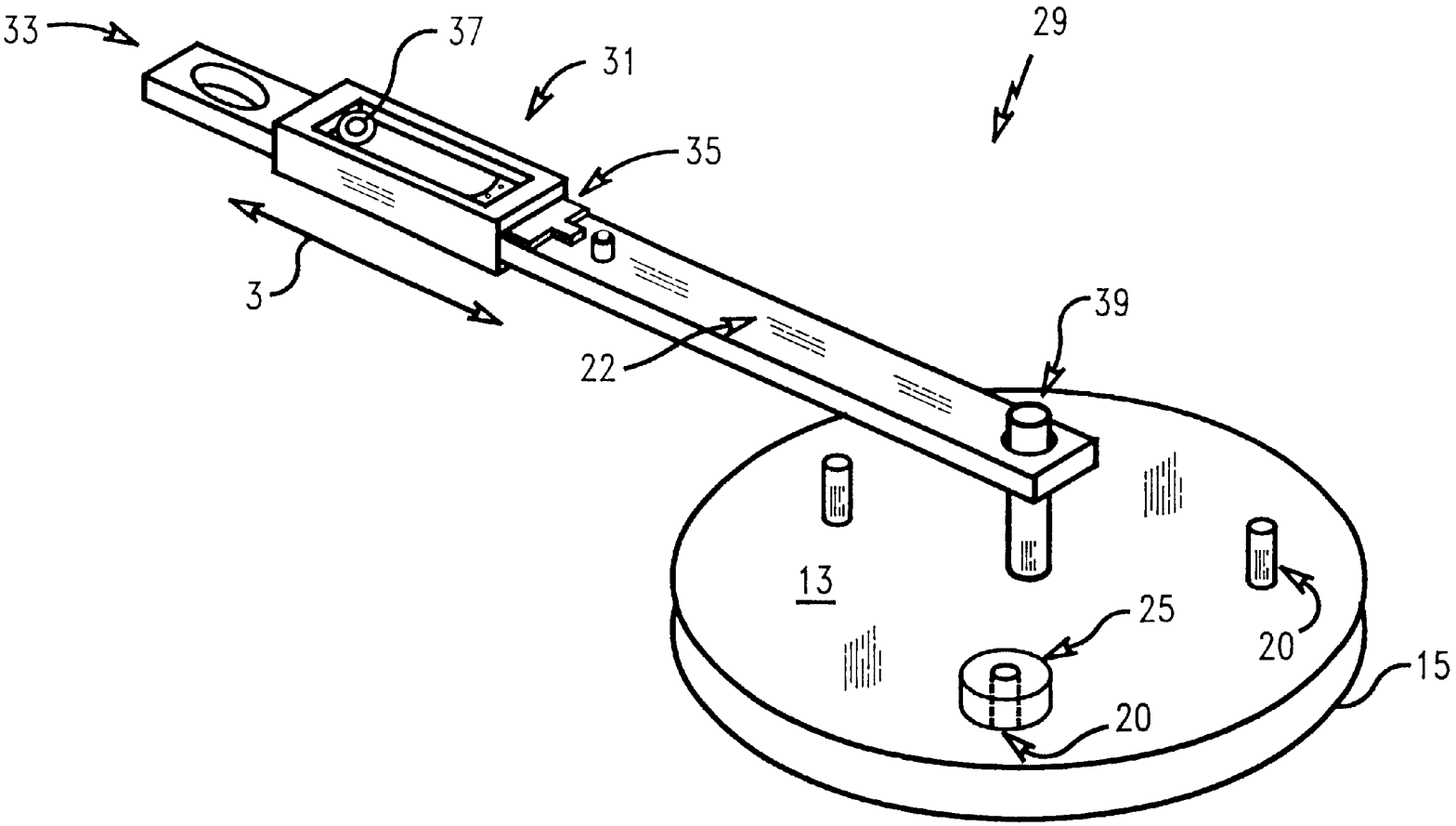
FIG. 2 is an elevational perspective view of the conditioner head connected to a cantilever having an oscillating portion.

In FIG. 2 a preferred embodiment of the present invention is shown in further detail. The conditioner head 15 is shown attached to cantilever 22 at point 39 such that conditioner head 15 is freely rotatable. Cantilever 22 can be mounted to a stationary object or on the CMP apparatus at location 33. It may also be designed to pivot at the points of connection 35 or 39 for placement of conditioner head 15 on and off the polishing pad 5. Furthermore, a motorized mechanism 31 may be added to extend and retract cantilever 22 such that conditioner head 15 moves in the directions of arrow 3 allowing conditioning of the entire pad if conditioner head 15 has a width smaller than the radius of the polishing pad. The variable length of the cantilever may be adjusted in-situ. The retraction and extension of the cantilever 22 permits conditioning and cleaning a polishing pad of any size. However, motorization of the cantilever is not necessary to practice the scope of the invention.

The top surface 13 of conditioner head 15 has a means for adjusting the contact force when placing the conditioner head 15 onto polishing pad 5. Means for adjusting the contact force of the conditioner head can comprise one or more small, cylindrical weights 25 fitted to conditioner head 15 using knobs 20. Alternatively, the weights can also be at least one metal plate having apertures corresponding to knobs 20 which lays on the top surface 13 of conditioner head 15.

Figure 3:
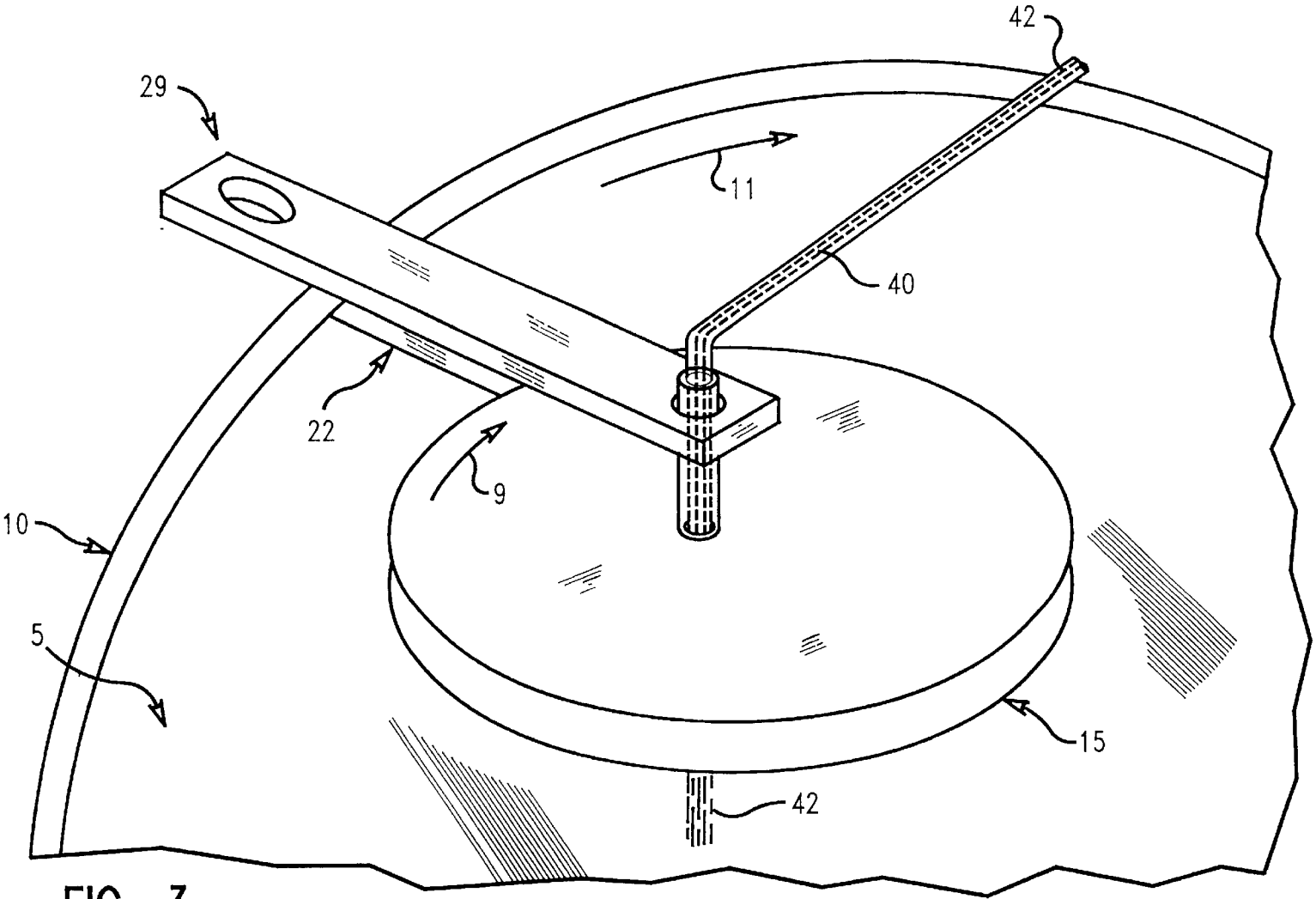
FIG. 3 is portion of a polishing pad shown with the conditioning and cleaning apparatus of the present invention in use.

FIG. 3 depicts how conditioner head 15 is disposed on a portion of polishing pad 5 in more detail. As platen 10 is rotating in direction 11, conditioner head 15 is rotating in direction 9 at or about the same speed as the platen rotational speed. The free-wheeling rotation of conditioner head 15 is due to the rotational energy of the rotating polishing pad 5. A hollow shaft 40 is attached to conditioner head 15. The shaft 40 is attached to a fluid source (not shown) which delivers a fluid 42 onto polishing pad 5 to flush away accumulated debris on the pad. The fluid 42 used to clean the polishing pad can be deionized water. The fluid flow may be continuous at a rate of about 10 mL/min. Alternatively, polishing pad 5 may be flushed with the fluid between polishings. Another embodiment would be to house hollow shaft 40 within cantilever 22.

Figure 4:
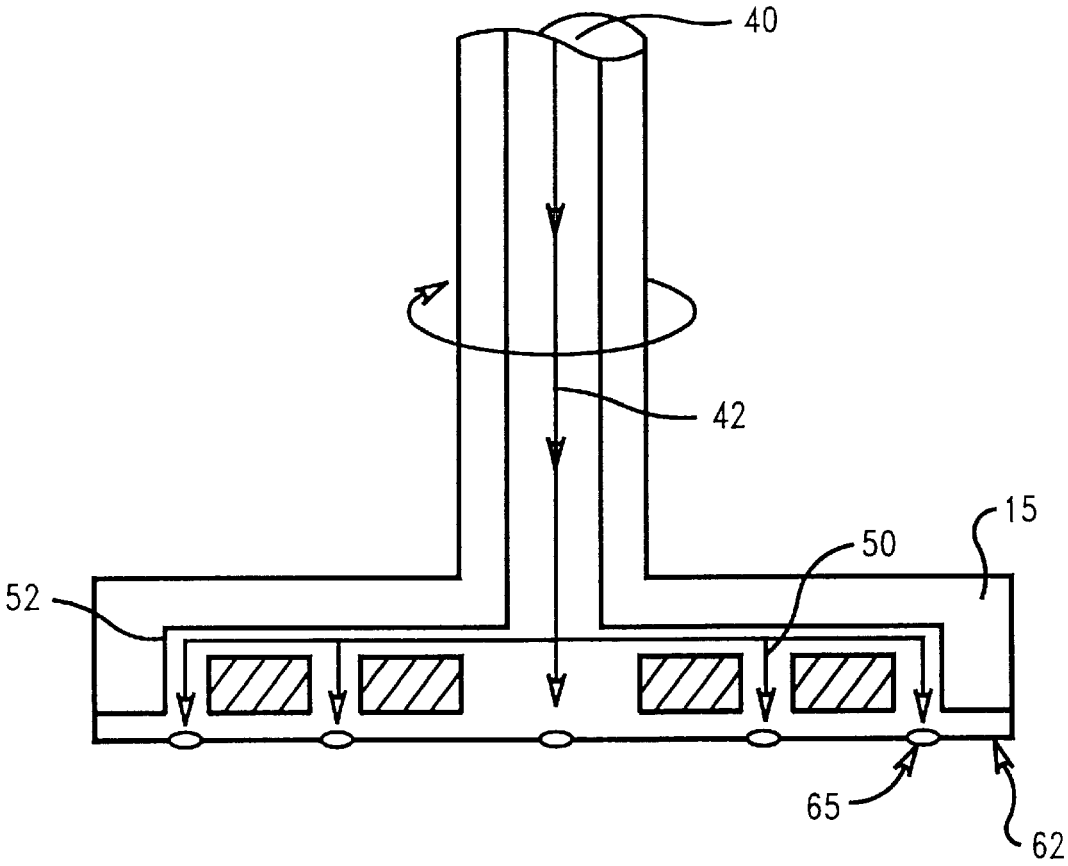
FIG. 4 is an elevational cross-sectional view of the conditioner head showing the trenches which direct the cleansing fluid.
Figure 5A:
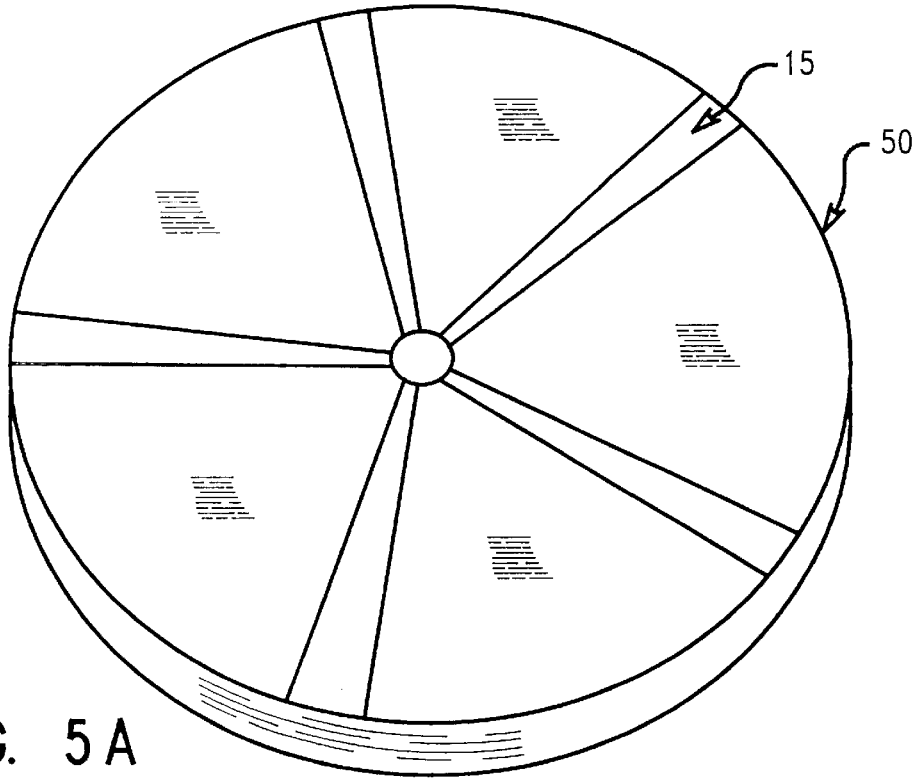
FIG. 5A is an elevational top view of the bottom portion of the conditioner head showing the pattern of the trenches according to one preferred embodiment of the present invention.

FIG. 4 shows a cross section of the conditioner head in further detail. The conditioner head 15 has a plurality of open trenches or channels 50 which direct the flow of fluid 42 in the direction of arrows 52. The trenches or channels 50, preferably, has a sand dollar pattern as shown in FIG. 5A.

An agitator 62 is attached to the bottom portion of conditioner head 15 to loosen any debris found on the polishing pad 5. The agitator comprises a roughened disc, preferably having a diamond media, manufactured and sold by Buehler, Microstructure Analysis Division, 41 Waukegan Road, Lake Bluff, Ill. 60044; Part No. 46-4301. The disc is purchased without apertures and must have the apertures drilled in a pattern corresponding to the trenches or channels of the conditioner head.

Figure 5B:
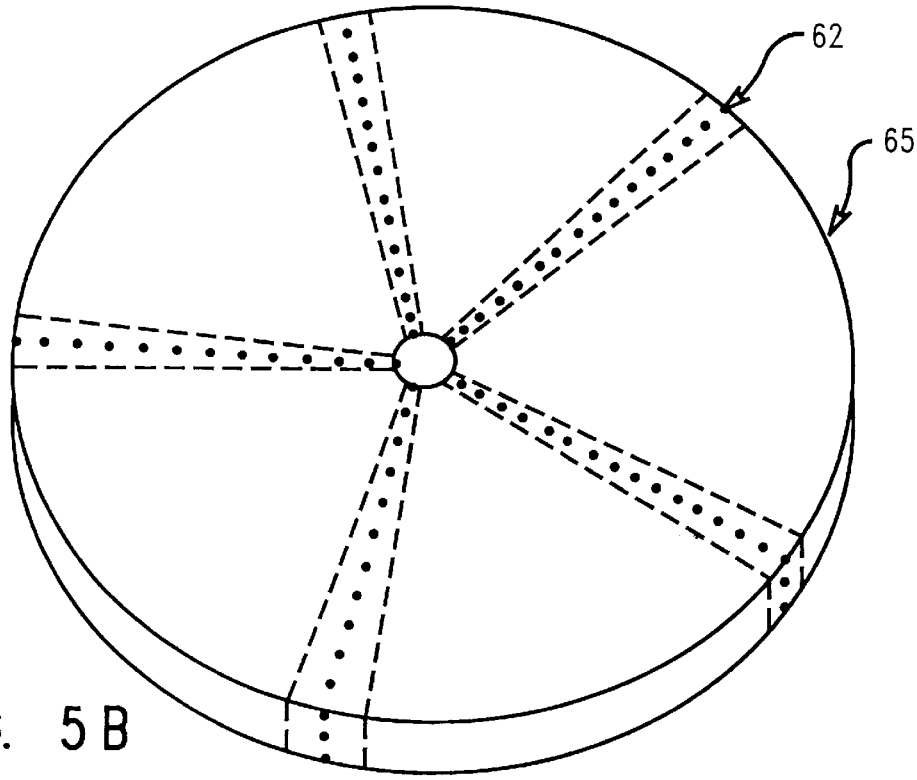
FIG. 5B is an elevational top view of the agitator to better illustrate the apertures corresponding to the trenches of the conditioner according to one preferred embodiment of the present invention.

The agitator 62 has a plurality of apertures 65, as shown in FIG. 5B, which allow the fluid 42 flowing from the fluid source, through the hollow shaft 40, into conditioner head 15, along channels 50, to be sprayed through the apertures 65 onto polishing pad 5. The apertures are about 1/32" to about 3/32" in diameter. There are approximately 16 to 32 holes drilled into the disc in a pattern corresponding to the trenches of the conditioner head.

The agitator is adhesively secured to conditioner head 15 such that fluid 42 does not leak along its periphery and the fluid is forced out only through apertures 65 at a sufficient force to loosen the debris accumulated on the polishing pad. The apertures 65 may be angled such that fluid 42 is sprayed at an angle to the polishing pad 5 to further facilitate loosening the debris associated with CMP.

The present invention achieves the objects recited above. The conditioning and cleaning apparatus of the present invention is a simple, low cost, low maintenance polishing pad conditioner compatible with the type of polishing apparatus used in CMP. The apparatus of the present invention does not require additional motorization because it is self-propelling thus, less maintenance is required. It provides in-situ conditioning and cleaning of the polishing pad simply be contacting the self-propelling, free-wheeling conditioner head on the polishing pad. A technician using the invention has fewer steps in operating the apparatus of the present invention and can polish several wafer lots while simultaneously conditioning and cleaning the polishing pad.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for in-situ conditioning and cleaning of a rotating polishing pad comprising:

a freely rotatable conditioner head having a top portion and a bottom portion, the bottom portion having a plurality of channels, said conditioner head being solely rotated by a rotational energy of said rotating polishing pad created by frictional contact alone of said conditioner head contacting said rotating polishing pad; and a hollow shaft extending from the top portion of said conditioner head connected to a fluid source, wherein a fluid is adapted to be delivered into said conditioner head through said hollow shaft to flow along the channels of said conditioner head.

2. The apparatus for in-situ conditioning and cleaning of a rotating polishing pad according to claim 1, wherein said plurality of channels are open to the bottom portion of said conditioner head and radially extend from the center of said conditioner head towards the edge of said conditioner head.

3. The apparatus for in-situ conditioning and cleaning of a rotating polishing pad according to claim 1, further including a conditioning pad attachable to the bottom portion of said conditioner head having a plurality of apertures corresponding to the channels of said conditioner head wherein said conditioner head is adapted to deliver fluid from said hollow shaft into said conditioner head along the channels, and out through the apertures of said conditioning pad.

4. The apparatus for in-situ conditioning and cleaning of a rotating polishing pad according to claim 1, wherein the top portion of said conditioner head has a means for adjusting the contact force of said conditioner head onto a polishing pad.

5. The apparatus for in-situ conditioning and cleaning of a rotating polishing pad according to claim 1, wherein said conditioner head is circular having a diameter from about the diameter of a wafer holder to about the radius of a polishing pad.

6. The apparatus for in-situ conditioning and cleaning of a rotating polishing pad according to claim 1, wherein said conditioner head is freely rotatable such that contact with a rotating polishing pad causes free rotation of said conditioner head at about the same speed as the rotating polishing pad wherein conditioning and cleaning of the polishing pad occurs during rotation of the polishing pad.

7. The apparatus for in-situ conditioning and cleaning of a rotating polishing pad according to claim 1, further including a cantilever attached to said conditioning head.

8. The apparatus for in-situ conditioning and cleaning of a rotating polishing pad according to claim 7, further including an extension and retraction means attached to one end of said cantilever for extending and retracting said conditioner head such that said conditioner head moves radially on a polishing pad allowing conditioning and cleaning of the entire polishing pad.

9. The apparatus for in-situ conditioning and cleaning of a rotating polishing pad according to claim 1, further including a roughened disc attached to the bottom portion of said conditioner head having a plurality of apertures corresponding to the channels of said conditioner head.

10. The apparatus for in-situ conditioning and cleaning of a rotating polishing pad according to claim 1, wherein said freely rotatable conditioner head further includes an agitator attached to the bottom portion of said conditioner head.

11. The apparatus for in-situ conditioning and cleaning of a rotating polishing pad according to claim 10, wherein said agitator has apertures provided therethrough in a pattern corresponding to said plurality of channels on the bottom portion of said conditioner head, such that said fluid may travel through said hollow shaft, into said conditioner head, along said channels of said conditioner head, and through said apertures of said agitator.

12. The apparatus for in-situ conditioning and cleaning of a rotating polishing pad according to claim 10, wherein said agitator comprises a roughened disc.

13. The apparatus for in-situ conditioning and cleaning of a rotating polishing pad according to claim 10, wherein said agitator comprises a roughened surface having a shape conforming to the shape of said conditioner head.

14. The apparatus for in-situ conditioning and cleaning of a rotating polishing pad according to claim 1, further including means for attaching weights to said conditioning head to adjust the contact force of said conditioning head on said polishing pad.

15. The apparatus for in-situ conditioning and cleaning of a rotating polishing pad according to claim 1, further including a holder for holding a wafer to be polished against said polishing pad, wherein said wafer holder is adapted to contact a first portion of said polishing pad while said freely rotatable conditioner head is adapted to contact a second portion of said polishing pad.

16. A method of conditioning and cleaning a polishing pad while simultaneously polishing a silicon wafer comprising the steps of:

(a) providing a rotatable polishing pad;

(b) providing a silicon wafer in need of polishing;

(c) providing a silicon wafer holder to contact said wafer with said polishing pad;

(d) providing a conditioning and cleaning apparatus having a freely rotatable conditioner head having a conditioning surface, said conditioning and cleaning apparatus adapted to deliver a cleansing fluid through said conditioning surface;

(e) rotating said polishing pad;

(f) contacting a first portion of the rotating polishing pad with said wafer to polish said wafer;

(g) delivering a cleansing fluid through the conditioning surface of said conditioning and cleaning apparatus; and (h) contacting a second portion of said rotating polishing pad with said freely rotatable conditioner head of said conditioning and cleaning apparatus to effect rotation of said conditioner head and to condition and clean said polishing pad, whereby said conditioner head is solely rotated by a rotational energy of said rotating polishing pad created by frictional contact alone of said conditioner head contacting said rotating polishing pad.

17. The method according to claim 16, wherein said conditioning and cleaning apparatus is connected to a fluid source such that the fluid flows into said free-wheeling conditioning and cleaning apparatus and is ejected out through the conditioning surface onto said polishing pad to wash away any polishing debris found on said polishing pad.

18. The method according to claim 17, wherein said conditioning surface has a plurality of apertures through which the cleansing fluid is ejected onto said polishing pad.

19. The method according to claim 16, further including the step of discontinuing said contacting of wafer to said polishing pad and cleaning said polishing pad by ejecting said cleansing fluid onto said polishing pad.

20. The method according to claim 16, wherein said conditioning and cleaning apparatus further includes the step of adjusting the contact force of said conditioning and cleaning apparatus onto said polishing pad.

21. The method according to claim 16, further including the step of radially moving said conditioning and cleaning apparatus over the surface of said polishing pad such that the entirety of said polishing pad is conditioned.

* * * * *